US007895963B2

(12) United States Patent
Roy

(10) Patent No.: US 7,895,963 B2
(45) Date of Patent: Mar. 1, 2011

(54) FLOATATION ELEMENT FOR VESSELS AND VESSEL COMPRISING ONE SUCH FLOATATION ELEMENT

(75) Inventor: Philippe Roy, Issy les Moulineaux (FR)

(73) Assignee: Zodiac International (FR)

( * ) Notice: Subject to any disclaimer, the term of this patent is extended or adjusted under 35 U.S.C. 154(b) by 385 days.

(21) Appl. No.: 11/886,364

(22) PCT Filed: Mar. 9, 2006

(86) PCT No.: PCT/FR2006/000523

§ 371 (c)(1),
(2), (4) Date: Sep. 14, 2007

(87) PCT Pub. No.: WO2006/097601

PCT Pub. Date: Sep. 21, 2006

(65) Prior Publication Data

US 2009/0056614 A1 Mar. 5, 2009

(30) Foreign Application Priority Data

Mar. 15, 2005 (FR) ..... 05 02558

(51) Int. Cl.
*B63B 43/10* (2006.01)

(52) U.S. Cl. ..... 114/357; 114/360

(58) Field of Classification Search ..... 114/68, 114/360, 357; 106/372

See application file for complete search history.

(56) References Cited

U.S. PATENT DOCUMENTS

| | | | | |
|---|---|---|---|---|
| 2,959,508 | A | 11/1960 | Graham et al. | |
| 3,585,157 | A * | 6/1971 | Beck | 521/54 |
| 3,596,622 | A | 8/1971 | Moore | |
| 5,218,919 | A * | 6/1993 | Krulikowski et al. | 114/74 A |
| 5,489,228 | A * | 2/1996 | Richardson et al. | 441/74 |
| 5,878,685 | A | 3/1999 | Hemphill et al. | |
| 2004/0069203 | A1 | 4/2004 | Fleming | |

FOREIGN PATENT DOCUMENTS

| | | |
|---|---|---|
| FR | 2782695 | 3/2000 |
| GB | 1537594 | 1/1979 |

* cited by examiner

*Primary Examiner* — Edwin Swinehart
(74) *Attorney, Agent, or Firm* — Dean W. Russell; Kristin M. Crall; Kilpatrick Stockton LLP

(57) ABSTRACT

The invention relates to a flotation element for vessels, consisting of concrete comprising closed-cell expanded foam beads, such as polypropylene beads, which are coated with a flexible binder, such as polyurethane, whereby the unfilled inter-bead volumes do not exceed approximately 20% of the volume of the floatation element. Preferably, one such floatation element comprises a concrete core as indicated above, a polyurethane coating around the core and a bonding film, such as polyurethane, which is disposed between the core and the coating. The invention is suitable for the construction of vessel floats.

12 Claims, 2 Drawing Sheets

FLOATATION ELEMENT FOR VESSELS AND VESSEL COMPRISING ONE SUCH FLOATATION ELEMENT

CROSS REFERENCE TO RELATED APPLICATIONS

This application is the U.S. national phase of International Application No. PCT/FR2006/00523 filed on Mar. 8, 2006, which application claims priority to French Patent Application No. 05 02558 filed on Mar. 15, 2005, the contents of which are incorporated herein by reference.

FIELD OF THE INVENTION

The present invention relates to improvements made to solid buoyancy elements, for example lateral floats, for vessels.

BACKGROUND OF THE INVENTION

Many embodiments of solid lateral floats for vessels are already known that make use of synthetic materials or most frequently of combinations of several synthetic materials at least some of which have a density less than that of water and procure the desired buoyancy. These materials are usually placed in successive layers surrounding a core made of a material of low density but of low mechanical strength and/or nonhydrophobic.

Particularly for example, documents U.S. Pat. No. 5,878,685, U.S. Pat. No. 6,371,040 B1, US 2004/0069203 A1 describe vessel floats of this type.

However, the known structures of solid floats are relatively complex to manufacture, use materials that may be costly and require expensive molds. These known solutions are therefore inappropriate for solid floats that can be made in economic conditions for example for fitting to bottom-of-the-range vessels, often of small dimensions, such as tenders.

SUMMARY OF THE INVENTION

The essential object of the invention is to propose an improved structure of a buoyancy block capable of being manufactured in attractive economic conditions and being able to serve to form buoyancy elements in various shapes for vessels of simple and economic design.

For these purposes, according to a first of its aspects, the invention proposes a buoyancy block for a vessel that is characterized, being arranged according to the invention, in that it comprises a concrete made of expanded foam balls with closed cells coated in a flexible binding, the unfilled volumes between the balls not exceeding approximately 20% of the volume of the buoyancy block.

According to a second of its aspects, the invention proposes a vessel with a rigid hull supporting at least one outer float extending at least bilaterally, in which this float consists of a buoyancy block as explained above.

DETAILED DESCRIPTION OF THE INVENTION

Figure 1:
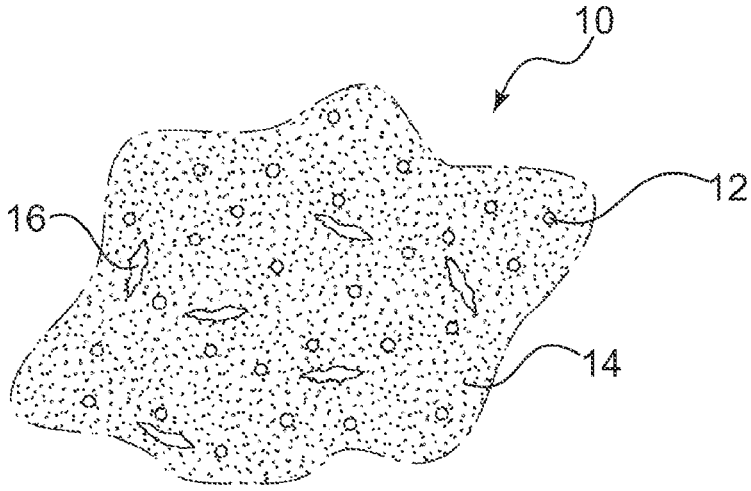
FIG. 1 shows a view of concrete made of expanded foam balls according to one embodiment of this invention.

According to a first of its aspects, the invention proposes a buoyancy block for a vessel that is characterized, being arranged according to the invention, in that it comprises a concrete 10 made of expanded foam balls 12 with closed cells coated in a flexible binding 14, the unfilled volumes 16 between the balls not exceeding approximately 20% of the volume of the buoyancy block. A exemplary embodiment is shown in FIG. 1.

It is specified here that, in the context of the invention, the term "concrete" should be understood in the figurative sense as designating a block of heterogeneous or composite structure, consisting of expanded foam balls with closed cells coated in a flexible binding.

The expanded balls may consist of various materials, such as polypropylene, polyethylene, polystyrene, etc. The flexible binding also may be chosen from several materials, such as polyurethane, a methacrylate, an epoxy resin, etc. However, in a preferred embodiment, the buoyancy block comprises a concrete of expanded polypropylene balls coated in a polyurethane binding, the unfilled volumes between the balls not exceeding approximately 20% of the volume of the buoyancy block.

Therefore, it is possible to obtain a relatively dense concrete, geometrically, made of very light expanded balls (with typically a density of the order of 15 kg/m$^3$) coated with a flexible binding, the whole element having a density of the order of 40 to 50 kg/m$^3$. Unlike a conventional molding process consisting in having the balls thermally dilated in a mold, which leads to a substantially homogeneous block of expanded balls stuck to one another with no free gaps between them, the process according to the invention consists in binding together balls that are already expanded; this process allows spaces to subsist which however must not exceed approximately 20%, preferably 10 to 15%, of the total volume of the buoyancy block. The material forming the balls is totally insensitive to water; such a concrete, even totally submerged in water, retains an excellent buoyancy of approximately 800 kg/m$^3$.

Figure 2:
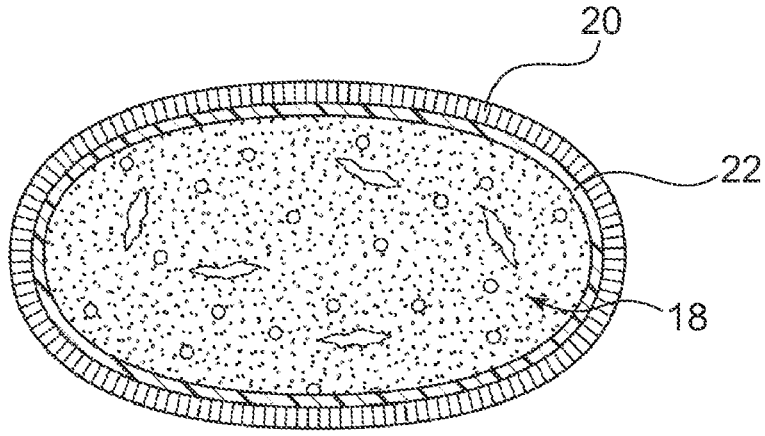
FIG. 2 shows a core of concrete having a coupling film and a coating skin according to an embodiment of this invention.

To be able to be used as a component element of a vessel, the buoyancy block shown in FIG. 2 comprises:

- a core 18 consisting of a concrete 10 as explained above,
- at least one polyurethane coating skin 20 coating the core 18, and
- a coupling film 22 interposed between the core 18 and the coating skin 20.

The coating skin forms the outer protection, that is both mechanical and a water seal, of the core. For this coating skin to have a sufficient mechanical strength particularly when it involves forming a lateral vessel float that must be capable of withstanding frictions and impacts, provision is made for this coating skin to have a thickness lying between approximately 1 and 10 mm depending on the applications and the type of exposure, and this thickness may typically be approximately 3 to 4 mm.

The appropriate coupling film for bonding the skin is chosen according to the materials constituting respectively the binding and the coating skin. Preferably, this film may be a glue or an appropriate polyurethane mastic with a polyurethane coating skin; but it is also possible to use an acrylic, methacrylate, etc. film if these materials are compatible.

In a buoyancy block thus arranged, the coating skin may, if necessary, be multiple.

Figure 3:
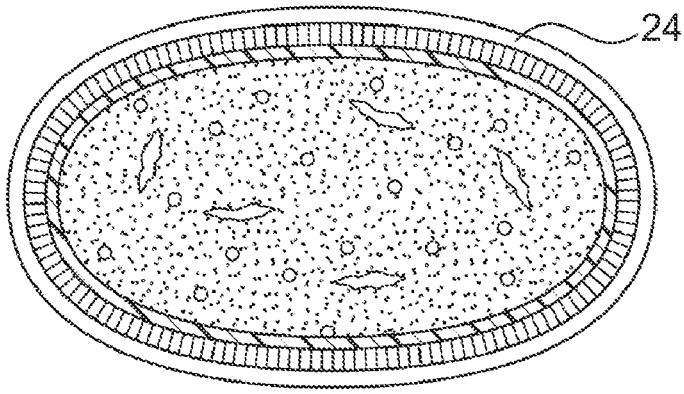
FIG. 3 shows the core of concrete of FIG. 2 with an outer layer.

It is also possible to provide for this coating skin to be covered at least partly by at least one outer layer 24, as shown in FIG. 3, the latter being able to be suitable for procuring for example a protection against ultraviolet rays and/or an additional seal against water and/or a determined external appearance (color, decoration, brightness, etc.). Such an outer layer 24 may for example consist of a layer of paint (for example polyurethane paint) and/or of "gel coat". This outer layer 24 may have a thickness lying between approximately 1 and 3 mm, typically of the order of 2 mm.

In addition, the coating skin may have a thickness that varies depending on the locations. It is then possible to envision forming this coating skin in two steps:

- a first portion is deposited by spraying or is poured into the bottom of a mold, before the core is put in place (this can for example involve the formation of the outer face of a vessel float, which requires a relatively great thickness, for example of the order of 2 to 10 mm, in order to be capable of withstanding abrasion and tearing;
- then, after the insertion of the core into the mold, resting on said first portion, a second portion is formed on the core itself (this can then involve the inner face of said float, that is less mechanically exposed and that requires a relatively lesser thickness, for example of the order of 1 to 3 mm, in order to procure the water seal).

Figure 4:
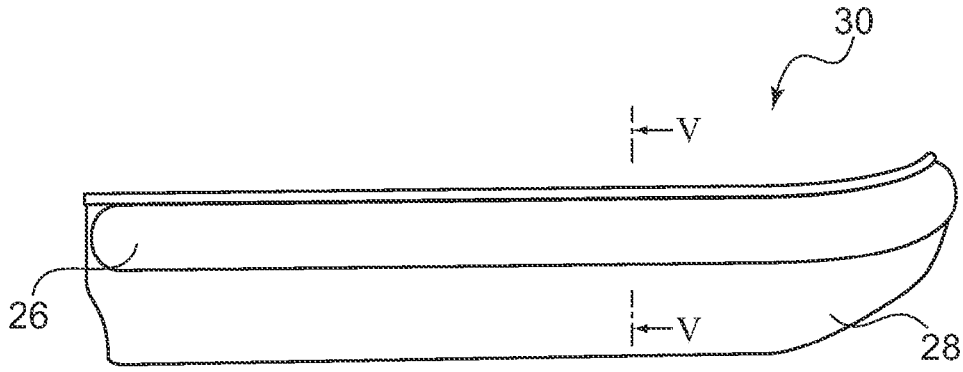
FIG. 4 shows a vessel having a buoyancy block formed as an elongated float.
Figure 5:
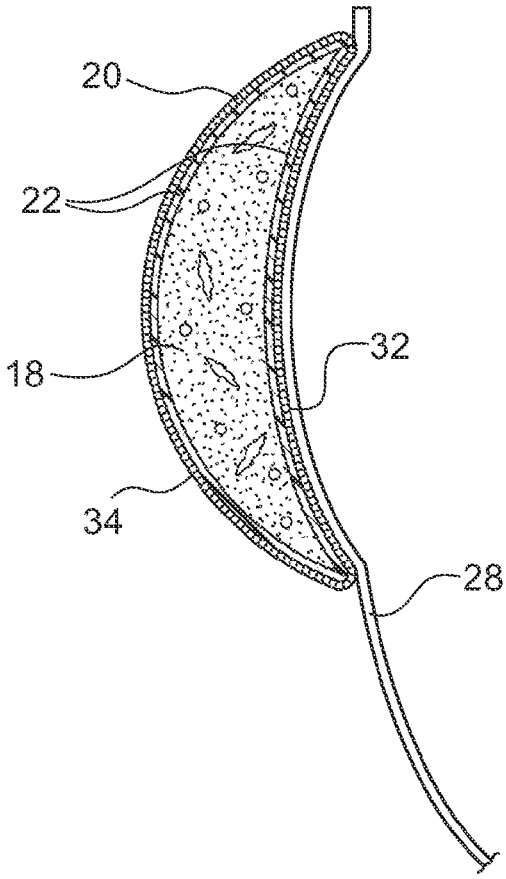
FIG. 5 shows a cross-sectional view along line V-V of FIG. 4.

A buoyancy block arranged as explained above may find various applications for equipping a vessel. One application that is particularly important, and most particularly the objective in the context of the present invention, consists in that this buoyancy block is conformed in the shape of an extruded elongated float 26 suitable for being fitted laterally to a hull 28 of a vessel 30, as shown in FIGS. 4 and 5. In a preferred exemplary embodiment, the buoyancy block conformed as a float 26 has:

- an inner face 32 making it suitable for being pressed against a rigid hull 28 of a vessel 30, which inner face 32 is substantially flat or conformed so as to complement the surface of the hull to be fitted and
- a convex outer face 34, which may, in a preferred exemplary embodiment, be approximately semi-cylindrical of revolution.

Therefore, thanks to the means proposed by the invention, the user has solid floats for the lateral fitting of vessels that are of simplified manufacture and, therefore, that are less costly than the solid floats currently known and that may therefore find an application for fitment particularly to bottom-of-the-range vessels such as tenders.

Figure 6:
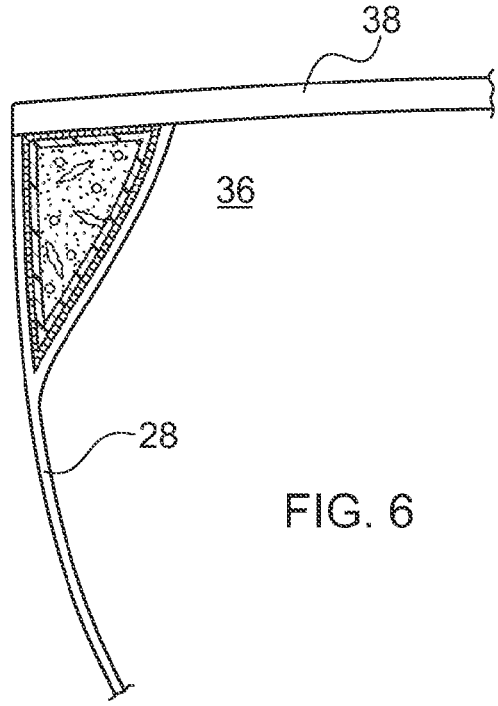
FIG. 6 shows a vessel having a buoyancy block enclosed in a free volume.

However, the use of the buoyancy block according to the invention is not limited to the production of lateral floats and it is possible to conceive that the buoyancy block according to the invention is conformed so as to be suitable for being inserted and enclosed in a free volume 36 of a vessel, for example in some or all of the hull 28 of the vessel 30 or else, when the vessel is thus arranged, in some or all of the free volume 36 between the hull 28 and a deck structure 38 that surmounts the latter. An example of this embodiment is shown in FIG. 6. These blocks inside the vessel may be placed jointly with outer floats, or else alone. In all cases, they increase the buoyancy of the vessel and constitute elements of insubmersibility.

It may be noted here that, although the arrangements that have just been mentioned for the constitution of buoyancy blocks inside a vessel are those that are preferred, there is however, still for the purpose of producing a buoyancy and insubmersibility block inside the vessel, nothing against having recourse to a different use which, when it is practically feasible, consists in forming the concrete of expanded balls coated in a binding directly in the free volume of the vessel, which then takes the place of a mold.

According to a second of its aspects, the invention proposes a vessel with a rigid hull 28 supporting at least one outer float 26 extending at least bilaterally, in which this float 26 consists of a buoyancy block as explained above. Advantageously in this case, the float 26 may be bonded to the rigid hull 28 with a polyurethane glue. In practice, in order to obtain a strong structure, it is desirable to ensure that the float 26 has an inner face 32, by which it rests against the rigid hull 28, that is substantially flat or conformed so as to complement the surface of the hull, and a convex outer face 34, that may preferably be approximately semicylindrical of revolution.

Whether the vessel is or is not fitted with at least one float arranged as has just been indicated, it is possible to provide that the vessel provided with a rigid hull incorporate at least one buoyancy block arranged as indicated above according to the invention and enclosed in a free volume 36 included at least partly in the rigid hull 28. In addition, if the rigid hull 28 is surmounted by a rigid deck structure 38, it is possible to provide that the buoyancy block be enclosed in a free volume 36 defined between the rigid hull and the rigid deck, as shown in FIG. 6.

The ability to install one or more buoyancy blocks in free locations of the vessel makes it possible to considerably increase the buoyancy of the vessel (insubmersibility) without encumbering the spaces assigned to the passengers. This solution may if necessary make it possible to reduce the volume of the outer floats and to give the vessel an esthetically original appearance without affecting its buoyancy.

An important advantage of the invention lies in the simplicity of obtaining the buoyancy block without cumbersome and costly toolage. The buoyancy block is formed without heating or at least without heating to high temperature, and without pressurization: all that is needed therefore is a light, low-cost mold. The use of such molds requires only a small amount of nonspecialist labor. In addition, its low cost makes it possible to increase the number of molds, for example in order to form products (floats, filler blocks) of various dimensions and shapes in response to user demand and/or to match different ranges of vessels.

When they are mass-produced, floats made according to the invention are less costly than pneumatic floats, while offering an eminently adequate floatation capability, even in the case of partial damage to a float.

Finally, an important advantage of floats made according to the invention lies in the very great ease of repair and restoration of a damaged float, with the possibility of regaining an outer appearance as satisfactory as the original.

The invention claimed is:

1. A buoyancy block for a vessel, comprising a concrete made of expanded foam balls with closed cells coated in a flexible binding, said concrete comprising unfilled volumes between the balls, said unfilled volumes not exceeding approximately 20% of the volume of the buoyancy block, wherein said expanded foam balls with closed cells are expanded polypropylene balls, wherein said flexible binding is a polyurethane binding, said concrete forming a core, said buoyancy block comprising at least one polyurethane coating skin coating the core, and a coupling film interposed between the core and the coating skin.

2. The buoyancy block as claimed in claim 1 wherein the coating skin has a thickness lying between approximately 1 and 10 mm.

3. The buoyancy block as claimed in claim 1 wherein the coating skin has a thickness lying between approximately 1 and 10 mm, and wherein the coating skin has a thickness of approximately 3 to 4 mm.

4. The buoyancy block as claimed in claim 1 wherein the coupling film is a polyurethane glue or adhesive.

5. The buoyancy block as claimed in claim 1, also comprising at least one external layer covering at least a portion of the coating skin.

6. The buoyancy block as claimed in claim 1, also comprising at least one external layer covering at least a portion of the coating skin and wherein the external layer has a thickness lying between approximately 1 and 3 mm.

7. The buoyancy block as claimed in claim 1, also comprising at least one external layer covering at least a portion of the coating skin, wherein the external layer has a thickness lying between approximately 1 and 3 mm, and wherein the external layer has a thickness of approximately 2 mm.

8. The buoyancy block as claimed in claim 1, which is conformed in the shape of an extruded elongated float suitable for being fitted laterally to a hull of a vessel.

9. The buoyancy block as claimed in claim 1, which is conformed in the shape of an extruded elongated float suitable for being fitted laterally to a hull of a vessel and which has an inner face making it suitable for being pressed against a rigid hull of a vessel, which inner face is substantially flat or conformed so as to complement the surface of the hull to be fitted and a convex outer face, particularly approximately semicylindrical of revolution.

10. The buoyancy block as claimed in claim 1, which is conformed so as to be suitable for being inserted and enclosed in a free volume of a vessel.

11. A vessel with a rigid hull, which incorporates at least one buoyancy block comprising:

a core consisting of a concrete made of expanded polypropylene balls coated in a polyurethane binding, said concrete comprising unfilled volumes between the balls, said unfilled volumes not exceeding approximately 20% of the volume of the buoyancy block, at least one polyurethane coating skin coating the core, and a coupling film interposed between the core and the coating skin, and which is conformed so as to be suitable for being inserted and enclosed in a free volume of a vessel included at least partly in the rigid hull.

12. The vessel as claimed in claim 11, in which the rigid hull is surmounted by a rigid deck structure, wherein the buoyancy block is enclosed in a volume defined between the rigid hull and the rigid deck.

* * * * *